United States Patent [19]

Yates

[11] Patent Number: 4,478,059

[45] Date of Patent: Oct. 23, 1984

[54] ADDITIVE DISPENSER SYSTEM FOR CLOTHES WASHING APPLIANCE

[75] Inventor: Roy K. Yates, Louisville, Ky.

[73] Assignee: General Electric Company, Louisville, Ky.

[21] Appl. No.: 530,908

[22] Filed: Sep. 12, 1983

[51] Int. Cl.[3] ..... D06F 39/02

[52] U.S. Cl. ..... 68/17 A

[58] Field of Search ..... 68/17 A, 17 R, 18 FA, 68/53, 207

[56] References Cited

U.S. PATENT DOCUMENTS

| | | | |
|---|---|---|---|
| 2,406,198 | 8/1946 | Clark | 68/17 A |
| 2,498,894 | 2/1950 | McCormick et al. | 68/17 A |
| 2,522,242 | 9/1950 | Wagner | 68/17 A X |
| 2,568,185 | 9/1951 | Clark | 68/17 A |
| 2,929,234 | 3/1960 | Castricone | 68/17 A |
| 2,933,912 | 4/1960 | Billings | 68/17 A |
| 2,953,006 | 9/1960 | Brucken et al. | 68/17 A |
| 2,970,463 | 2/1961 | Johnston | 68/17 A |
| 2,976,711 | 3/1961 | Smith | 68/17 A |
| 2,979,935 | 4/1961 | Oles | 68/207 |
| 2,982,120 | 5/1961 | Plensky | 68/207 |
| 3,053,066 | 9/1962 | Dodd | 68/17 A X |
| 3,085,417 | 4/1963 | Oles | 68/17 A |
| 3,091,108 | 5/1963 | Martin et al. | 68/17 A |
| 3,150,511 | 9/1964 | Ballard | 68/17 A X |
| 3,314,253 | 4/1967 | Smith | 68/18 |
| 3,330,135 | 7/1967 | Douglas | 68/18 FA |
| 3,370,444 | 2/1968 | Wolters | 68/207 |
| 3,724,242 | 4/1973 | Davis | 68/17 A |

FOREIGN PATENT DOCUMENTS 1074061 6/1967 United Kingdom .

*Primary Examiner*—Philip R. Coe

*Attorney, Agent, or Firm*—Frank P. Giacalone; Radford M. Reams

[57] ABSTRACT

The present invention relates to improvements in clothes washing machines of the type having an inner clothes wash basket and an outer water-retaining tub, and more particularly to an additive dispenser system mounted on the hollow post type agitator and including an additive diverter on the basket bottom wall for introducing additive to the outer water-retaining tub free of contact with the clothes being washed.

9 Claims, 5 Drawing Figures

ADDITIVE DISPENSER SYSTEM FOR CLOTHES WASHING APPLIANCE

BACKGROUND OF THE INVENTION

The invention relates to an automatic clothes washing machine and more particularly to such machines where it is intended that a first treating agent may be introduced prior to beginning of a washing operation and a second treating agent may be automatically introduced into the machine subsequent to the washing cycle in a manner which precludes contact with the clothes being washed.

Automatic clothes washing machines customarily proceed through a sequence of operations in order to wash, rinse and dry clothes. The sequence ordinarily includes a washing operation, a rinsing operation in which the clothes are rinsed in clean water, and a final extraction operation in which the rinse water is removed from the clothes. Additive dispensers have been provided so that the operator may introduce a measured amount of detergent or soap prior to the start of the operation. In the same manner, appropriate water softeners and fabric softeners may be automatically added to the rinse water even though put in the machine prior to the start of the cycle.

In addition to detergents, soap and softening agents, it will readily occur that a suitable liquid bleach or bleaching agent are among the more important additives required by many operators for a large part of their washing operations. The dispensing of bleach raises peculiar problems in that it is imperative that the bleach not directly contact the clothes before they are submerged in water or until the bleach is diluted in water. Also, due to the difficulties created by the highly corrosive nature of most of the commercially available bleaches provided for clothes washing purposes, it is necessary that great care be taken in the storage of bleach. To this end, some prior art attempts at dispensing bleach has been to provide a separate dispenser means for bleach which enables the operator to place the bleach directly into the outer tub where it may be diluted during the water fill operation. While this solves the problem of dispensing bleach, it does require a dispenser separate from the dispenser used for dispensing other additives and is therefore somewhat inconvenient.

Accordingly, it is an object of the invention to provide an additive dispenser adapted to be mounted on the oscillatory agitator which is adapted to deliver a charge of liquid rinse additive into the basket following a sequence of operations which include a washing operation and a high speed centrifugal extraction of the wash water, which extraction immediately precedes the operation in which the liquid rinse addition is to be utilized, and is further adapted to permit a liquid bleach to be dispensed directly into the outer tub prior to the washing cycle where it will be diluted by the water entering during the initial fill operation.

SUMMARY OF THE INVENTION

The present invention relates to a clothes washing appliance of the vertical axis type having an imperforate outer tub for retaining washing liquid and a basket mounted in the tub for containing clothes to be washed. The basket has a perforate side wall and a bottom wall including liquid circulating openings which slopes downwardly from a position adjacent the vertical axis to a lower portion at the outer circumference of the side wall. Mounted in the basket on the vertical axis for rotation with said basket is an agitator for imparting washing action to the clothes. The washing operation is carried out by drive means that effect a relatively low rotational speed oscillation of the agitator during a washing action of the clothes and a high spin speed rotation of the basket during a high spin extraction action. The agitator includes a central housing means in the form of a hollow centerpost defining a conduit extending through the hollow centerpost between an open upper end to its lower end adjacent the bottom wall of said basket.

An additive dispensing means is arranged in the upper end of the centerpost defining an outer housing and a cavity having its lower end portion positioned in the hollow centerpost for receiving additive to be dispensed. The cavity is spaced from the outer housing to provide a passageway therebetween so that the additive being discharged from the cavity by centrifugal force during the extraction action will flow through the passageway and the conduit in the hollow centerpost to a position on the bottom wall of the basket below the agitator. Included in the dispenser is a passageway arranged to bypass the cavity and to communicate directly with the hollow centerpost for introducing treating agent to a position on the bottom wall below the agitator for dilution by liquid entering the outer tub during a subsequent fill operation.

An additive diverting means including a body portion is positioned on at least a portion of the sloping bottom wall of the basket which includes openings aligned with the liquid circulating openings in the bottom wall of the basket for conducting additive therethrough into the outer tub to insure that the additive will be diluted in the liquid introduced into the outer tub prior to a subsequent washing action.

DESCRIPTION OF THE PREFERRED EMBODIMENT

Figure 1:
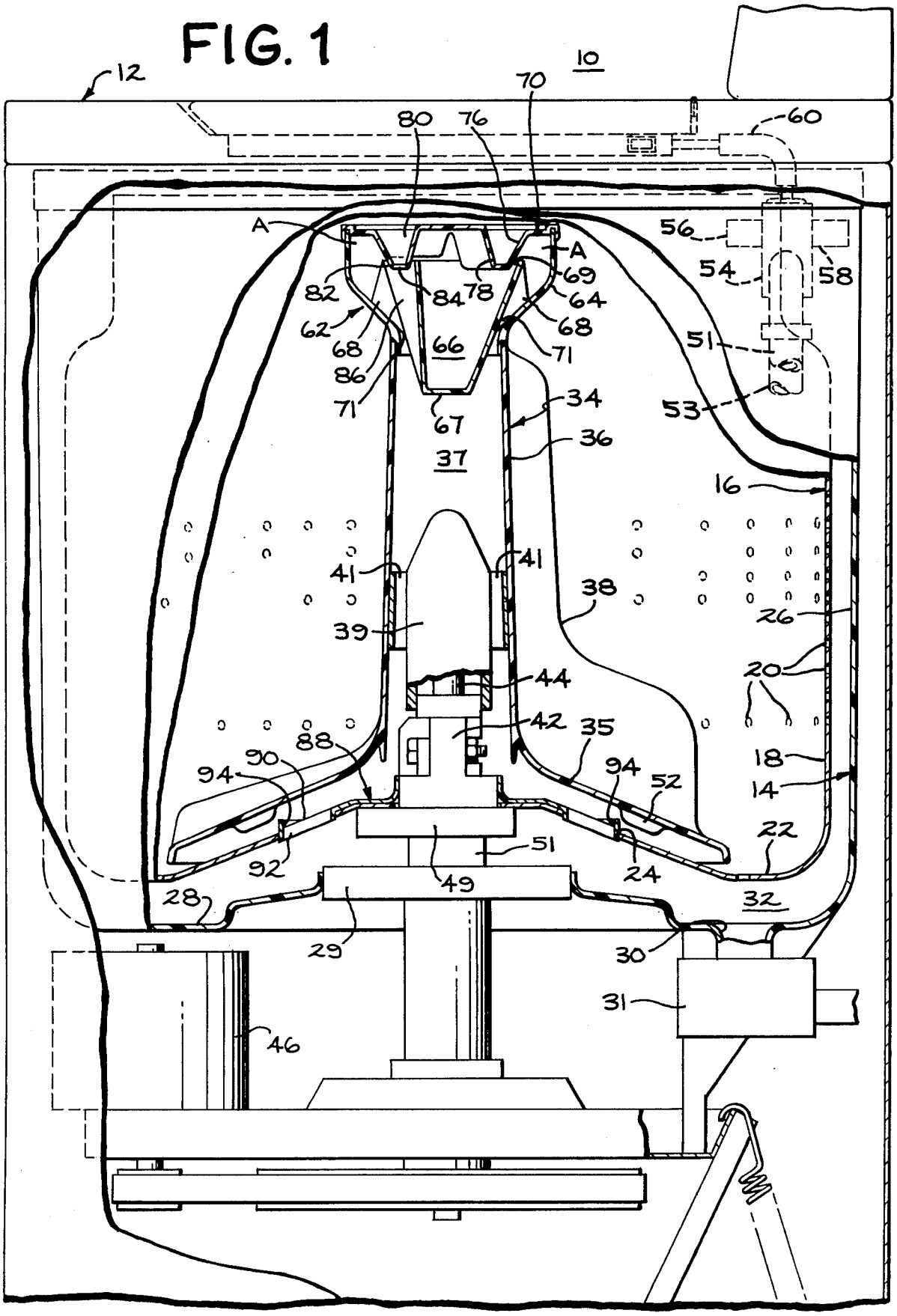
FIG. 1 is a side elevational view of a vertical axis clothes washing machine including one embodiment of the additive dispensing system of the present invention, the view being partially broken away in order to illustrate details.

Referring to FIG. 1, there is shown a vertical axis washing machine 10 of the vertical axis type which includes a cabinet 12. Within the cabinet 12 is disposed an imperforate stationary outer tub 14. Within the imperforate tub 14 there is disposed a basket or receptacle 16 for receiving fabric articles, such as clothing, to be washed. The basket side wall 18 includes a plurality of apertures 20 for discharge of water during a centrifugal extraction or fast spinning portion of the operating cycle of the machine. The bottom wall 22 of the basket 16 slopes downwardly from the center axis to a lower portion at the outer circumference of the side wall 18. A plurality of openings 24 (FIGS. 1 and 3) are formed in the bottom wall 22 which, as will be explained hereinafter, function in recirculating liquid between the basket 16 and tub 14 during the wash operation. The tub 14 is comprised of an imperforate side wall 26 and a generally imperforate and substantially horizontally disposed bottom wall 28 having a single drain opening 30 formed in a sump portion 32 of the bottom wall 28. The tub is mounted on a stationary support flange 29 arranged on the vertical axis. At the center of the basket 16 there is positioned a vertical axis agitator 34 which includes a vertical hollow centerpost 36 defining a passageway 37, a base or skirt portion 35 spaced from the bottom wall 22 and a plurality of vanes 38 extending outwardly from the vertical post 36 thereof. The agitator hollow centerpost 36 is concentrically mounted about a centerpost 42, and is driven by an oscillatory agitator drive shaft 44 by means of a drive motor 46. The agitator is mounted on the shaft 44 through a centering means 39 which drivingly engages the inner wall of passageway 37. The centering means 39 is formed with a plurality of apertures 41 which provide means of communication between the upper portion of passageway 37 and the lower portion which communicates with basket bottom wall 22 beneath the skirt portion 35 of agitator 34. The basket 16 is mounted on a flange 47 of a rotatable spin hub 49, and is driven by a sleeve 51 by means of the motor 46.

The skirt portion 35 of the agitator 34 extends outwardly and downwardly in spaced relationship with the bottom wall 22 of basket 16. The area between the skirt 35 and wall 22 forms an agitator driven pump through which liquid is pumped radially outwardly by pumping vanes 52 formed on the skirt 35. During the washing portion of the cycle, the vanes drain liquid from the lower portion of tub 14 through openings 24 and flows outwardly by the centrifugal force imparted by the agitator 34. Liquid then flows through the holes 20 and downwardly into the tub sump area 32 and then returned to the interior of the basket through openings 24.

Hot and cold water may be supplied to the machine through conduits 51 and 53 which are adapted to be connected respectively to sources of hot and cold water (not shown). Conduits 51 and 53 extend into a conventional mixing valve structure 54 having solenoids 56 and 58 and being connected to a hose 60 which is positioned to discharge water into the basket 16. In a conventional manner selective or concurrent energization of the solenoids 56 and 58 will provide the passage of hot, cold or warm water from the mixing valve 54 through hose 60 to discharge water into the basket 16 and tub 14.

During operation of the machine in the washing cycle, the agitator 34 driven by shaft 44 through centering means 39 is first oscillated back and forth within the basket 16 to wash clothes therein. Then, after a predetermined period of this washing action, the basket 16 is driven by spin hub 49, and then rotated at high speed to extract centrifugally the washing liquid and discharge it into the outer tub 14 for draining from the machine through the drain openings 30. Liquid from the drain 30 is carried from the machine by a pump 31 which may be energized during the extraction operation or a selected portion thereof.

Figure 2:
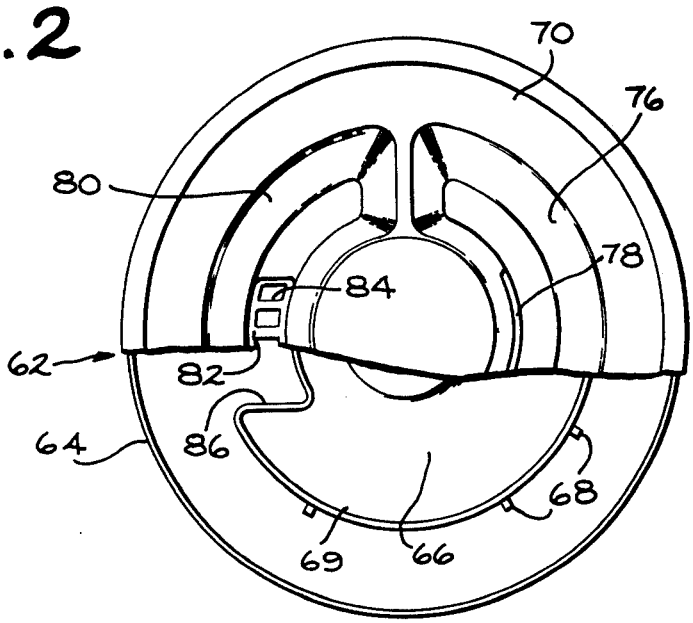
FIG. 2 is a plan view partially broken away showing certain details of the dispensing system of FIG. 1.

In accordance with the present invention and as clearly illustrated in the drawings, the hollow centerpost 36 of the agitator serves to house and support the dispenser device generally indicated at 62. The dispenser device 62 of one embodiment of the present invention, as shown in FIGS. 1 and 2, is adapted to deliver additive which when dispensed at full strength should normally not come into direct contact with clothes being washed. The additives contemplated by the present invention are, for example, rinse agents which have a tendency to spot clothes and liquid bleach which will damage cloth if allowed to contact cloth at full strength. In the embodiment shown in FIGS. 1 and 2 of the drawing, the dispensing device 62 comprises an outer bowl-shaped housing 64 that extends above the centerpost and radially outwardly therefrom. Arranged concentrically in the outer housing 64 is a cone-shaped cavity 66 having its lower narrow end 67 concentrically arranged within the dimensions of the hollow passageway 37 of centerpost 36 and its larger upper open end 69 positioned within the housing 64. The cavity 66 is spaced from inner walls of passageway 37 and housing 64 by a plurality of radial spokes 68 which provide a passageway 71 in communication with the interior of the housing 64 and the passageway 37.

Means are provided for allowing additive, such as a rinse agent, to be inserted into the dispenser device 62. To this end, a cover portion 70 is arranged on the housing 64. The cover as shown in FIG. 2 is formed with a first arcuate additive-receiving channel or depression 76. The arcuate channel 76 is dimensioned so that the downwardly extending side walls thereof are positioned within the upper open end 69 of cavity 66, as shown in FIG. 1. A dispensing opening 78 is provided in the bottom wall of the channel 76 to facilitate the introduction of rinse agent to the cavity 66. The opening 78 is shown in FIG. 2 as being a single arcuate opening; however, a plurality of spaced openings may be effectively employed. Rinse agent additive to be introduced into cavity 66 is placed in the channel 76 and allowed to flow through opening 78 into the cavity 66 to be dispensed therefrom.

In operation, the rinse agent placed in cavity 66 prior to the washing operation is held in cavity 66 during oscillation or washing action of the agitator. During the ensuing high spin extraction cycle, the rinse agent is centrifugally thrown out over the top open end 69 of cavity 66 and into an area designated "A" (FIG. 1) in the upper portion of the inner peripheral wall of the housing 64. At the completion of the extraction cycle, the rinse agent as indicated by arrows will then flow downwardly from the area "A" of housing 64 through passageway 71 and into passageway 37, aperture 41, to the bottom wall 22 of the basket 16 in a position below the skirt portion 35 where it then flows downwardly toward openings 24 and into the bottom of tub 14. The rinse agent according to the invention has therefore been inserted into the washing machine in a manner that precludes its coming into contact with the clothes being washed in the basket.

In dispensing liquid bleach, the cover portion 70 (FIG. 2) is provided with a second arcuate bleach-receiving channel or depression 80 having its side walls extending downwardly to a position above the upper open end 69 of cavity 66. The channel 80 is further formed with a funnel-shaped sump 82 which extends downwardly from channel 80. The sump is formed to include a discharge opening 84. It is imperative, as mentioned above, that the bleach not come in contact with clothes being washed. However, it is also imperative that the bleach not mix with the rinse agent since the chemical reaction between the two is not desirable.

Accordingly, while the sump 82 extends below the upper edge of the cavity 66 it is positioned outside of cavity 66. To this end, as shown in FIGS. 1 and 2, a passageway is provided in the form of a detent or depression 86 formed in the side wall of cavity 66. The sump 82 is positioned within the dimensions of the passageway 86. Accordingly, the sump 82 including opening 84 communicates with the passageway 37 through the passageway provided by depression 86 and passageway 71.

In operation, the liquid bleach is inserted into channel 80 prior to the washing operation. The bleach introduced into channel 80 flows directly through depression 86 and passageway 37 of centerpost 36 to the bottom wall 22 of basket 16 and toward openings 24 to the bottom of tub 14 prior to the washing cycle in the same manner as the rinse agent is introduced into tub 14 subsequent to the extraction cycle following the wash cycle. The liquid bleach so directed to the outer tub is then in a position to be diluted by the wash water as it enters the outer tub 14 prior to the washing cycle.

Figure 3:
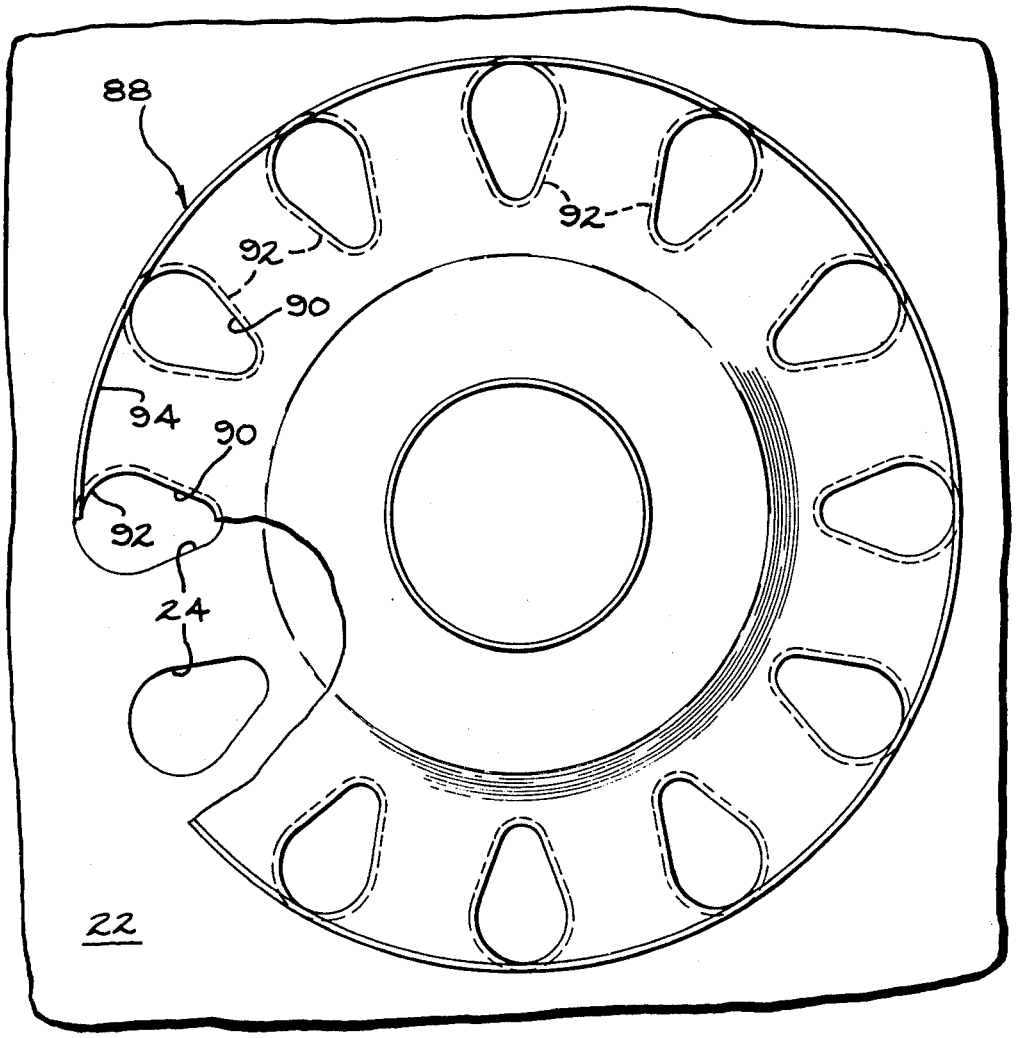
FIG. 3 is a plan view of the additive diverter employed in the dispensing system of the present invention.

Referring to FIGS. 1 and 3, there are shown means provided by the present invention to insure that all of the rinse agent and liquid bleach flowing through passageway 37 of centerpost 36 flows through openings 24 and into the outer tub 14. To this end, a dish-shaped diverter member 88 (FIG. 3) is provided which is shaped comlementary to the bottom wall 22. The diverter member 88 arranged on the wall 22 is dimensioned to be located completely below the skirt 35 of agitator 34 as shown in FIG. 1. As shown in FIG. 3, the member 88 is formed with a central collar portion which is positioned on the centerpost 42. Also formed on member 88 are a plurality of openings 90 which match in number and shape the openings 24 in bottom wall 22. Extending downwardly along the peripheral edge portion of the openings 90 is a wall portion 92 which acts to index member 88 relative to wall 22 and to align openings 90 thereof with openings 24 in wall 22. An upwardly extending circumferential wall 94 is formed so as to be tangent with the outer radial edge portion of the openings 90. The wall 94 is impervious to insure that all of the rinse agent and liquid bleach flowing through centerpost 36 and downwardly on wall 22 is directed through the opening 90 and, accordingly, opening 24.

Figure 4:
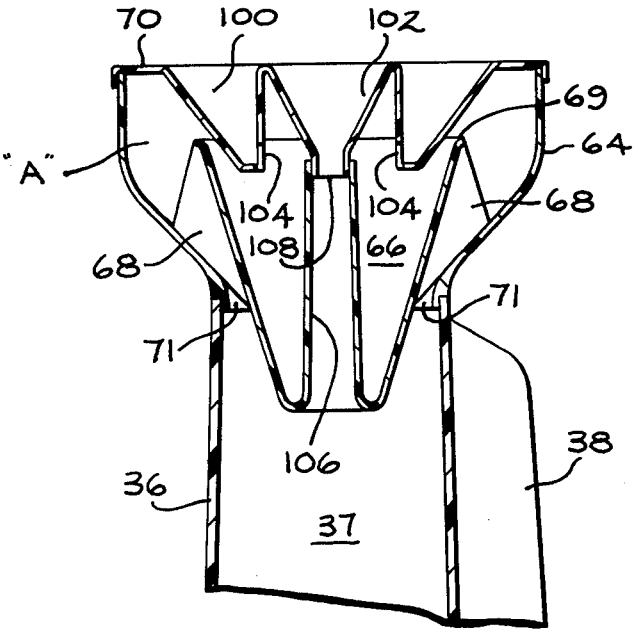
FIG. 4 is a side elevational view of another embodiment of the additive dispenser employed in the dispensing system of the present invention.

Referring now to FIG. 4 of the drawings, there is shown another embodiment of the invention wherein similar parts are designated by the same reference characters employed in describing the embodiment of FIGS. 1 and 2. The cover 70 in this embodiment is formed with an annular channel 100 for receiving the rinse agent to be dispensed in cavity 66, and a central funnel-shaped channel 102 for receiving the bleach to be dispensed into the passageway 37 of centerpost 36. The channel 100 has its lower annular wall positioned within and below the peripheral upper end 69 of the cavity. Formed in the lower wall of channel 100 are a plurality of circumferentially disposed openings 104 communicating with the cavity 66. Rinse agent introduced into the cavity 66 through openings 104 is delivered to the tub 14 in the same manner described in the embodiment of FIGS. 1 and 2. In this embodiment, bleach is delivered into passageway 37 through a central conduit 106 extending vertically through and isolated from cavity 66. The channel 102 has its lower open end 108 positioned in the upper open end of conduit 106 so that bleach introduced into central channel 102 bypasses cavity 66 and flows directly through the passageway 37 in centerpost 36 in the same manner described in the embodiment of FIGS. 1 and 2.

Figure 5:
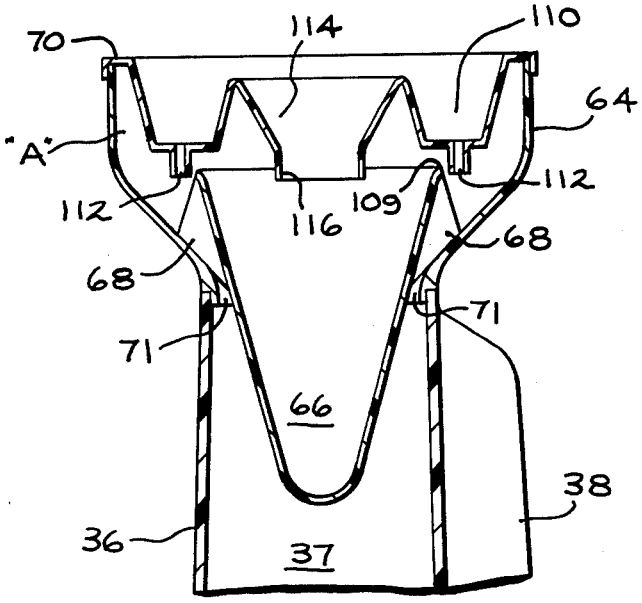
FIG. 5 is a side elevational view of still another embodiment of the additive dispenser.

Referring now to FIG. 5, there is shown still another embodiment of the invention wherein similar parts are designated by the reference characters employed in the embodiment of FIGS. 1 and 2. The cover portion 70 in this embodiment is formed to include an annular channel 110 for receiving liquid bleach. Formed in the lower wall of channel 110 are a plurality of openings 112 which are located radially outwardly of the outer upper end 69 of cavity 66 so that liquid bleach introduced into channel 110 is received directly into the passageway 37 of centerpost 36 through passageway 71 and therethrough in the same manner described in the embodiment of FIGS. 1 and 2. Rinse agent in this embodiment is introduced into the cavity 66 through a central funnel-shaped channel 114 formed in the cover 70 which has its lower open end 116 arranged over the cavity 66.

In summary, by the present invention a dispenser system has been provided wherein additive may be introduced into the machine without coming directly into contact with the clothes being washed. In the case of dispensing liquid bleach, it is inserted into the washing machine in a manner which precludes its coming into contact with clothes to be washed and in a position wherein the initial liquid fill cycle will dilute the bleach prior to the start of the wash cycle, while in the case of dispensing rinse agent, it will be delivered into the washing machine after the initial wash cycle and extraction cycle in a manner which also precludes its coming into contact with the clothes to be washed.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. An additive dispensing system for a clothes washing appliance of the vertical axis type, comprising:

an imperforate outer tub for retaining washing liquid;

a basket mounted in the tub for containing clothes to be washed having a perforate side wall and a bottom wall including liquid circulating openings, said bottom wall sloping downwardly from an upper position adjacent said vertical axis to a lower portion adjacent said side wall;

an agitator mounted in said basket on said vertical axis for rotation with said basket;

drive means for effecting a relatively low rotational speed oscillation of said agitator during a washing action of said clothes and a high spin speed rotation of said basket during spin extraction action;

said agitator including housing means in the form of a hollow imperforate centerpost defining a conduit extending through said hollow centerpost between an open upper end to an open lower end adjacent the bottom wall of said basket;

an additive dispensing means arranged in the open upper end of said hollow imperforate centerpost including a passageway arranged for introducing treating agent through said hollow imperforate centerpost to a position on the bottom wall of said basket inwardly of said liquid circulating openings;

additive diverting means including a body portion positioned on at least a portion of said sloping bottom wall of said basket having liquid diverting openings aligned with said liquid circulating openings in said bottom wall of said basket for conducting additive therethrough into said outer tub to thereby cause said additive to mix with said washing liquid retained in said outer tub.

2. The additive dispensing system recited in claim 1 wherein said additive dispensing means further includes a housing mounted on said open end of said hollow centerpost, a cavity arranged in said housing for holding an additive, said cavity being spaced from said housing to provide a passageway between said cavity and said housing whereby said additive discharged from said cavity by centrifugal force during said extraction action will flow through said passageway and downwardly through said hollow centerpost.

3. The additive dispensing system recited in claim 2 wherein said body portion of said additive diverting means is formed to include downwardly extending wall portions adjacent the peripheral edge of said liquid diverting openings dimensioned to extend into said liquid circulating openings in said bottom wall of said basket for aligning said openings and indexing said body portion of said additive diverting means relative to said bottom wall of said basket.

4. The additive dispensing system recited in claim 3 wherein said body portion of said additive diverting means is further formed to include an upwardly extending circumferentially disposed wall section along its outer edge being substantially tangent with the outer radial edge portion of said liquid diverting opening in said body member for preventing additive to flow downwardly past said liquid diverting openings and for insuring that all of said additive passing through said hollow centerpost is directed through said liquid diverting openings.

5. The additive dispensing system recited in claim 4 wherein said additive dispensing means further includes a second passageway arranged to by-pass said cavity and communicate with said hollow centerpost for introducing additive directly into said hollow centerpost to the bottom wall of said basket.

6. The additive dispensing system recited in claim 5 wherein said cavity is formed to provide said second passageway for allowing additive to be introduced directly into said centerpost.

7. The additive dispensing system recited in claim 4 further including a cover including a first additive-receiving channel having a discharge opening overlying said cavity so that additive placed in said first additive-receiving channel is received in said cavity, and a second additive-receiving channel having a discharge opening arranged to communicate with said passageway between said cavity and said housing to by-pass said cavity so that additive placed in said second additive-receiving channel flows directly through said hollow centerpost.

8. The additive dispensing system recited in claim 7 wherein said cavity includes a centrally arranged passageway extending therethrough between an open end in said cavity and an open lower end in said hollow centerpost and said second additive-receiving channel discharge opening is arranged to communicate with said centrally arranged passageway for introducing additive directly to said hollow centerpost.

9. The additive dispensing system recited in claim 8 wherein said second additive-receiving channel includes a plurality of circumferentially disposed discharge openings arranged to communicate with said passageway between said housing and said cavity for introducing additive directly into said hollow centerpost.

* * * * *